United States Patent [19]

Remond et al.

[11] 3,953,381

[45] Apr. 27, 1976

[54] COMPOSITION CONTAINING DIAMIDE AND HALOCARBON FOR TREATMENT OF SURFACES

[75] Inventors: Jean-Pierre Remond, Massy-Villaine; Jean-Claude Vitat, Antony; Jean-Robert Thebault, Paris, all of France

[73] Assignee: Rhone-Progil, Courbevoie, France

[22] Filed: Nov. 7, 1973

[21] Appl. No.: 413,607

[30] Foreign Application Priority Data

Nov. 9, 1972 France ..... 72.39677
May 8, 1973 France ..... 73.16473

[52] U.S. Cl. ..... 252/544; 252/153; 252/172

[51] Int. Cl.[2] ..... C11D 3/32; C11D 7/32; C11D 7/30

[58] Field of Search ..... 252/544, 153, 172

[56] References Cited

UNITED STATES PATENTS

| | | | |
|---|---|---|---|
| 3,003,247 | 10/1961 | Sherliker | 252/153 |
| 3,285,856 | 11/1966 | Lew | 252/544 |
| 3,318,817 | 5/1967 | Smith | 252/544 X |
| 3,553,142 | 1/1971 | Figiel et al. | 252/153 X |
| 3,577,348 | 5/1971 | Clementson | 252/153 |
| 3,634,272 | 1/1972 | Valenta et al. | 252/153 |

*Primary Examiner*—Benjamin R. Padgett
*Assistant Examiner*—Edward A. Miller
*Attorney, Agent, or Firm*—McDougall, Hersh & Scott

[57] ABSTRACT

A homogeneous liquid composition for use in the treatment of surfaces to remove water and other materials in which the composition is formulated of 90 to 99.95% by weight of a solvent, at least 50% by weight of which is trichloro-1,1,2-trifluoro-1,2,2-ethane and 0.05% to 10% by weight of one or more diamides having the general formula in which R is a saturated or unsaturated aliphatic hydrocarbon having 1 to 25 carbon atoms, $R^1$ is an aliphatic hydrocarbon group having 10 to 30 carbon atoms and at least one ethylenic double bond, and *n* is a number from 1 to 9.

9 Claims, 2 Drawing Figures

COMPOSITION CONTAINING DIAMIDE AND HALOCARBON FOR TREATMENT OF SURFACES

The present invention relates to a composition, method and apparatus for the treatment of surfaces, particularly for the complete removal of water from the surfaces.

It frequently happens that surfaces of articles come into contact with water in various treatment processes and are consequently wet. This happens, for example, with metallic manufactured articles, the surfaces of which retain water after processing and cleaning. Likewise, in the electric and electronic industries, elements which are to be cleaned are frequently mounted in supports of plastics materials and in certain cases the pieces to be superficially cleaned are washed in water to eliminate, for example, water-soluble salts or residual flux used in soldering. In other cases, the humidity of the ambient atmosphere may have an undesirable affect on the efficient functioning of articles if they are not dried before use and sealed moisture proof enclosures. Further, the presence of water on various metallic surfaces gives rise to the phenomenon of corrosion which may undesirably alter the mechanical and/or electrical properties of the article.

It is known to remove water from certain surfaces by means of alcohol or acetone. However, these liquids are inflammable and relatively toxic.

It is also possible to remove water from surfaces by simple heating. However, such heating requires relatively large drying installations and the time required for removing the last traces of water tends to be quite long. This method also requires the use of relatively high temperatures and thus cannot be used for articles having heat sensitive surfaces.

It is also possible to remove water by means of a jet of compressed air or nitrogen but the drying obtained by this means is frequently inefficient and incomplete.

More recently there has been described in French Pat. No. 1,515,393 a composition for the removal of water from solid metal surfaces, such as of steel and brass. The composition comprises trichloro-1,1,2-trifluoro-1,2,2,ethane, containing a dissolved material derived from a phosphate of a mono or dialcoyl and a saturated aliphatic amine having 6–20 carbon atoms, such as ethyl-2-hexylamine. However, drying by means of such a composition gives inadequate results in certain cases when the surfaces concerned are non-metallic or only partially metallic, especially in the case of printed electronic circuits.

Finally in French Pat. No. 2,040,733 description is made of a composition comprising from 90–99.95% by weight of a solvent containing more than 50% of its weight of trichloro-1,2,2-trifluoro-1,2,2,ethane, and from 10 to 0.05% by weight of a salt of at least one diamine with one or more aliphatic acids having 10–30 carbon atoms containing at least one double bond, the diamine having the formula $R—NH—(CH_2)_n—NH_2$, in which R is a saturated or unsaturated aliphatic group having from 1–25 carbon atoms and $n$ is a whole number of from 1 to 9. This composition gives satisfactory results when used for drying articles. However, in certain cases where the quantity of water to be removed from the surfaces is relatively large, there exists the risk of loss of drying composition. Such losses arise from the fact that a significant amount of water and of the drying composition form an emulsion. There is thus obtained three layers, an aqueous layer, an intermediate layer which is a heterogeneous mixture of water and drying composition, and an organic layer comprising the initial drying composition. The intermediate layer is milky white and may present a turbid appearance to the naked eye depending on the quantity of water in the emulsion. This tendency to form relatively stable aqueous emulsions entails the risk of loss of drying composition during decantation by entrainment in the upper layer, which comprises water of the intermediate layer containing water and drying composition.

It is an object of this invention to avoid or ameliorate these difficulties and especially to prevent the formation of aqueous emulsions thereby to avoid the loss of drying composition during decantation, while maintaining a high drying efficiency during successive treatment cycles.

Another object of this invention is to provide a process which is capable of removing not only water but also undesired solid particles from surfaces of articles of metal, plastics material, refractory materials, glass and/or textile materials, particularly of articles used in the electric and electronic, mechanical, optical, textile, chemicals, horology, jewelery and meteorology industries, without the use of inflammable solvents, compressed gases, or excessively high temperatures.

In accordance with one aspect of the invention, there is provided a homogeneous liquid composition, comprising (a) from 90 to 99.95% by weight of a solvent containing at least 50% by weight of trichloro-1,1,2-trifluoro-1,2,2,ethane, and (b) from 0.05 to 10% by weight of one or more diamides having the formula (I):

$$R^1—CO—\underset{\underset{R}{|}}{N}(CH_2)_n—NH—CO—R^1$$

in which R is a saturated or unsaturated aliphatic hydrocarbon group having from 1 to 25 carbon atoms, R′ is an aliphatic hydrocarbon group having from 10 to 30 carbon atoms and at least one ethylenic (C=C) double bond, and $n$ is a whole number from 1 to 9.

In a preferred embodiment of this invention, the radical R of the diamide has from 11 to 20 carbon atoms and the unsaturated aliphatic hydrocarbon R′ group, having 10 to 20 carbon atoms, contains one or two ethylenic double bonds and 11 to 18 carbon atoms.

R may for example be a caprylyl, capryl, lauryl, myristyl, palmityl, stearyl or an oleyl group, preferably when $n$ is 3. A mixture of these groups may also be used.

By way of example, a non-saturated aliphatic hydrocarbon group having from 10 to 30 carbon atoms may be undecylenyl, dodecylenyl, tetradecylenyl, hexadecylenyl, octadecylenyl (linolenyl) hydroxyoctadecylenyl (ricinoleyl) acetyloctadecylenyl (acetylricinoleyl) or a mixture of these groups.

The preferred diamides for use in the invention are dioleyl-oleylamidopropylene amide, diundecylenyloleylamidopropylene amide, dioleylstearylamidopropylene amide, dioleylpalmitylamidopropylene amide, dilinoleyloleylamidopropylene amide and a mixture of two or more of these diamides.

The preparation of the diamides may be carried out by reacting 0.5 to 3 mols, preferably about 2 mols, of the unsaturated aliphatic acid having the formula R′—COOH with one mol of diamine having the formula $R—NH—(CH_2)_n—NH_2$, with heating, in any appropriate organic solvent and eliminating the water formed in the reaction. It is advantageous to use toluene as the solvent and to eliminate the water during the formation thereof by azeotropic distillation with toluene. The diamides thus obtained may be added to trichloro-1,1,2-trifluoro-1,2,2,ethane in order to obtain the compositions of the invention.

The diamides may contain, as impurities in relatively small quantities for example less than about 5% and preferably less than 2% by weight of the diamide, salts which result from the stoichiometric reaction of the diamines and acids, which salts have not been subjected to dehydration to transform them to diamides. It may even be advantageous in certain cases to have present a quantity of diamine salts up to 10% by weight of the diamide content.

The solvent containing more than 50% of its weight of trichloro-1,1,2-trifluoro-1,2,2,ethane, and which is one of the constituents of the compositions of the invention, may also contain one or more saturated chlorinated or chlorofluorinated aliphatic hydrocarbons having one or two carbon atoms selected from the group comprising chloroform, methylene chloride, dichloroethane, trichloroethane, tetrachloro-1,1,2,2-ethane, tetrachloro-1,1,2,2-difluoro-1,2-ethane and trichlorofluoro methane.

The water removed from the treated surfaces form droplets which rapidly separate in an upper layer of water which is easily removed by decantation. Washing of the surfaces with an appropriate solvent, preferably trichloro-1,1,2-trifluoro-1,2,2-ethane, allows traces of diamide, which may remain on the surfaces, to be eliminated. This operation is not necessary if the traces of diamide have no undesirable affect on the articles treated. Finally, the solvent may be removed from the surfaces by evaporation to leave a surface which is completely free from a deposit of material.

Surfaces treated by means of compositions of this invention are not altered in general in any way by the treatment described above. These surfaces may be of metal, such as ferrous metals, stainless steel, nickel and its alloys, chromium and its alloys, copper, brass, bronze, cadmium, alloys based on silver, gold, platinum and titanium, silicone and germanium; plastics materials which are not attacked by the compositions, such as polyamides, polytetrafluoroethylene, hexafluoropropylenevinylidene fluoride copolymers, polyolefins, chlorosulphinated polyolefins, vinyl polymers and copolymers, chlorinated and/or fluorinated vinyl polymers and copolymers, polyesters, polycarbonates, polymethacrylates, acrylonitrilebutadienestyrene copolymers, butadieneacrylonitrile and butadienestyrene copolymers, polystyrene, polychlorobutadiene and resonants based on urea and formaldehyde; glass or refractory materials, such as alumina, silica or magnesia and precious stones. Because of their excellent properties the compositions of the invention are especially recommended for drying of cinematic films, printed circuits, precision instruments, such as microscopes, balances, and control apparatus, and electric motors.

Regarding the drying of metal surfaces, the treatment effected by means of compositions of the invention prevents corrosion of these surfaces without altering the surface. This is particularly important when the articles are manufactured and finished with a very fine tolerance, as is the case of ball bearings.

The process for removing water and undesired particles from the surfaces to be treated may be effected in general by contacting the surfaces with the composition, for example by spraying, brushing or sprinkling or by immersion of the surfaces for wetting the surface with the liquid composition. In the latter case it is desirable to agitate the bath of liquid. The agitation may be carried out in any convenient manner, preferably by ultrasonic devices and/or by heating to the boiling point.

In a preferred embodiment of the method of the invention, there is provided a continuous method for removing water and undesired particles from a surface which comprises immersing the surface successively in a bath (A) comprising a composition according to the invention maintained at boiling point, then in a rinsing bath (B) comprising said solvent and also maintained at boiling point, and finally passing the surface in the vapors consisting essentially of solvent vapors from baths (A) and (B), while continuously recovering and condensing said vapors, removing water contained in the condensate, adding the condensed solvent to bath (B), passing excess of solvent from bath (B) to bath (A), and recycling excess of liquid from bath (A) back to bath (A) after removing water from said excess of liquid from bath (A).

The method of the invention may be carried out using relatively simple apparatus owing to the absence of the formation of emulsions.

One form of apparatus which may be used comprises a vessel for eliminating water, a rinsing vessel, a decantation vessel for decanting water, and recycling means for recycling the liquid composition from the decantation vessel to the vessel for eliminating water.

The vessel for the removal of water and the rinsing vessel may be provided with heating means and may be arranged adjacent to each other. The space above the vessel for elimination of water and the rinsing vessel is generally surrounded by walls the upper parts of which are surrounded by condenser. Means may be provided for passing liquid from the rinsing vessel to the vessel for elimination of water and also means for passing liquid from the vessel for eliminating water to a decantation vessel.

Means may also be provided for recovering condensate obtained by condensation of vapors above the vessel for eliminating water and the rinsing vessel.

Means for removing water which may be contained in the condensate and means for passing the condensed solvent to the rinsing bath.

It is a feature of the apparatus of the invention that the vessel for decanting off the water comprises a single compartment.

In one embodiment of the apparatus, means for recycling the liquid composition from the decantation vessel to the vessel for eliminating water comprises a thermosiphon.

The accompanying drawings are given by way of illustration but not by way of limitation of a preferred apparatus for use in the present invention, in which.

Figure 1:
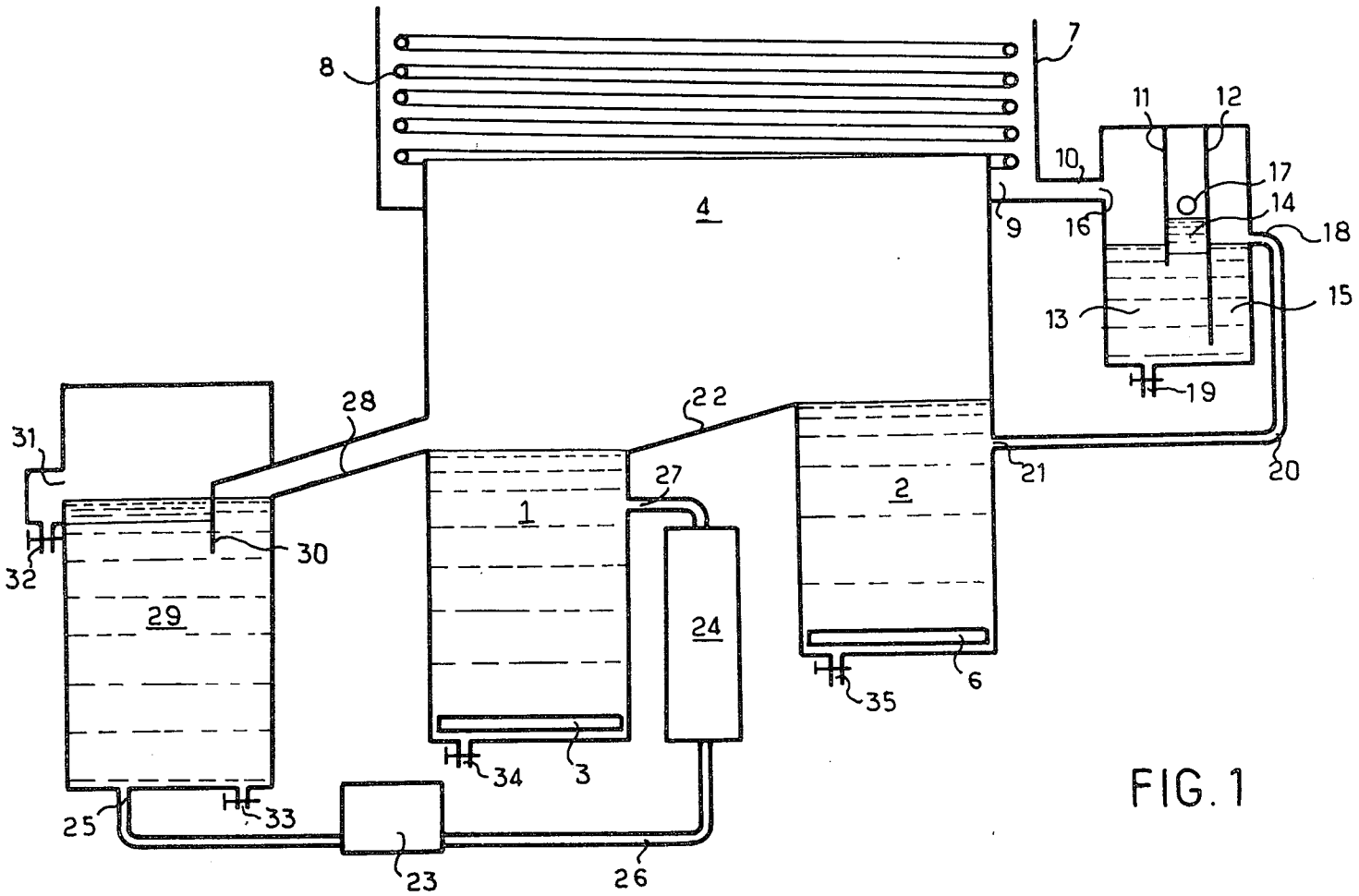
FIG. 1 is a schematic side elevation view of the apparatus.

The apparatus will now be described with reference to the process for the invention.

The surfaces to be treated for eliminating water are immersed in the bath (A) consisting of the composition according to the invention and contained in a bath 1.

The bath (A) is heated to boiling point by means of a heating apparatus 3 which may, for example, be a calrod or other electric heating element. The boiling provides efficient agitation of the bath which facilitates mechanical removal of the water from the surfaces treated. This agitation may in certain cases be increased by the use of known agitating means, preferably ultrasonic mixers.

Another advantage of heating to boiling is that liquid contained in the rinsing vessel 2 may be continuously regenerated by condensation of the solvent vapor from vessel 1.

The vapors emitted by vessel 1 rise into the space 4 situated above vessels 1 and 2, defined by the walls 7, and are condensed by condensor coils 8, which are cooled by circulation therethrough of a cold liquid such as water. The coils 8 are fixed to the upper part of walls 7 or included in said walls.

The condensate, recovered in channel 9, flows through conduit 10 into a separator consisting of a vessel internally divided by partitions 11 and 12 into three compartments 13, 14 and 15.

The compartments communicating with each other only at their lower portions below the partitions 11 and 12.

The water separator also has an inlet 16 for a mixture of water and solvent, an outlet for water 17, an outlet 18 for solvent, a cooling jacket 36 (FIG. 2) cooled by means of cold liquids, such as water and a valve 19 in the bottom wall for emptying the vessel.

The water separator is intended to remove water which may be present in the condensate and which may be derived from either by absorption of moisture from the atmosphere or from the articles in the vessel 1 and which may be entrained with the solvent in the space 4 during boiling.

The water-solvent mixture, coming from channel 10, enters the separator through inlet 16 and separates into two constituents by decantation in the first compartment 13 of the separator.

The greatest portion of the water present on the surface collects in compartment 14 and is removed by the outlet 17.

The heavier solvent separates by gravity into compartment 15 and is returned to vessel 2 through outlet 18 and the duct 20.

The diamide of the composition contained in the vessel 1, being neither volatile nor entrainable in the solvent vapor, the vessel 2 is fed only with pure solvent by means of the inlet 21. The only possible source of diamide in the vessel 2 is due to small quantities of diamide which remain on the articles to be treated after treatment in the vessel 1, when they are introduced into the vessel 2 for the rinsing operation. The bath (B) contained in the vessel 2 is raised to boiling point by means of heating apparatus 6, such as electrical heaters of the type described. This boiling allows efficient agitation of the bath, which enhances elimination of the diamide present on the articles and the last traces of dirt.

The excess solvent in the vessel 2 which is generated overflows through an open channel 22 into the vessel 1 so that the losses therein, due to evaporation of the contents of the vessel, are compensated.

The vessel 1 is fed in continuous fashion with the compositions of this invention by means of a pump 23 and/or a thermosiphon 24 in conjunction with an outlet 25, duct 26 and inlet 27 arranged to introduce said composition to the bath contained in the vessel 1.

The thermosiphon 24 is formed of a reservoir which is heated in known manner, at an adjustable heat input, to obtain a variable rate of recycling. In FIG. 1 the thermosiphon 24 and the vessel 1 are separated. According to another embodiment of the apparatus, the vessel 1 and the thermosiphon 24 are side by side, the thermosiphon 24 forming a jacket on the wall of the vessel 1 on the side opposite to the wall having the output for liquid from the vessel 1.

The thermosiphon 24 has the advantage of allowing recycling of the composition in the vessel 1 without the assistance of a pump and also contributes to the obtention of boiling of the composition in the vessel 1. However, it may be preferable, especially for apparatus having a large capacity, to replace the thermosiphon 24 by a pump 23 or to use both units simultaneously as shown.

The excess of liquid in the vessel 1 flows continuously along an open channel 28 into the decantation vessel 29.

In another embodiment of the apparatus, the vessel 1 and the vessel 29 are adjacent and separated simply by a vertical partition. The vapor rising into space 4 is returned by the deflector 30.

Water removed in the vessel 1 forms into droplets which coalesce rapidly owing to the agitation of the liquid in the bath and an aqueous layer is obtained which is easy to decanter in the single compartment of the decantation vessel 29.

The water decantered from the upper part of the bath contained in the decantation vessel 29 is removed through the outlet orifice 31.

The apparatus is completed by valves 32, 33, 34 and 35 for evacuation of the various vessels.

Figure 2:
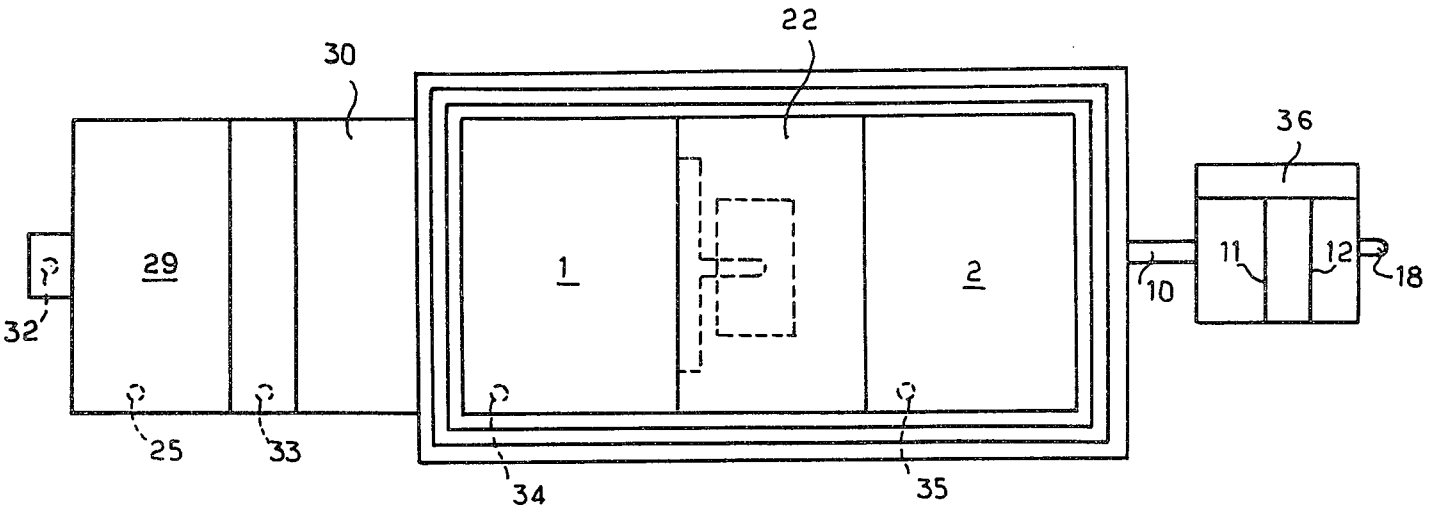
FIG. 2 is a top plan view of the apparatus of FIG. 1.

According to another embodiment of the apparatus which is not shown in FIGS. 1 or 2, the vessel for eliminating water, the rinsing vessel and the decantation vessel are arranged such that the lines of flow of liquid from the elimination vessel toward the decantation vessel are substantially perpendicular to the lines of flow of solvent from the rinsing vessel toward the elimination vessel. This arrangement allows construction of the elimination bath and the rinsing bath as a single unit separated only by a simple vertical partition.

According to the process of the invention, the apparatus is used as follows.

The vessel 2 is filled with pure solvent in such a manner that it rises to the upper part of the channel 22 when it is raised to boiling point.

Compartments 13, 14 and 15 of the water separator are also filled with solvent to the point at which the solvent flows through the outlet 18.

The vessel 1 is filled with the drying composition such that the bath so formed overflows into channel 28 when it boils.

The decantation vessel 29 is also filled with the drying composition up to the level slightly above the lower end of the deflector 30. In order to avoid loss of solvent due to evaporation, the composition contained in the decantation vessel 29 is covered with a layer of water such that, at its upper level, it flows through the orifice 31.

The heating devices 3 and 6, the heating apparatus for thermosiphon 24, if required, the cooling circuits 8 and 36 and possibly the pump 23 are then put into operation.

Once the system has reached a steady state, the equilibrium of the liquid levels is adjusted by addition or removal of pure solvent.

The heat input required is a function of the dimensions of the vessels and hence the volume of the baths, the quantity of heat lost through the articles introduced into the apparatus, and by return to the vessels 1 and 2 of cooled liquid.

The examples given below are intended to illustrate but not limit the present invention.

In the following examples the compositions of the invention are prepared as follows.

The diamides are prepared by adding 2 mols of aliphatic non-saturated acid to 1 mol of diamine. There is thus formed an intermediate salt of diamine corresponding to the aliphatic acid used. This diamine salt is then heated to a temperature of 120°C to 140°C, in the presence of about two liters of toluene, and water generated in the reaction is removed by azeotropic distillation with toluene. The remaining toluene is separated at the end of the reaction by distillation under partial vacuum. The diamides thus obtained are dissolved in trichloro-1,1,2-trifluoro-1,2,2-ethane.

The diamines used in the preparation of the diamides are oleyl aminopropyleneamine and stearyl aminopropyleneamine.

The oleyl aminopropyleneamine obtainable commercially has approximately the following composition.

85% of oleyl aminopropyleneamine
5% of stearyl aminopropyleneamine
10% of palmityl aminopropyleneamine Likewise, the stearyl aminopropyleneamine obtainable commercially has approximately the following composition.

30% of stearyl aminopropyleneamine
40% of oleyl aminopropyleneamine
30% of palmityl aminopropyleneamine The unsaturated aliphatic acids used in the preparation of the diamides are the following: oleic acid, undecylenic acid and linoleic acid.

EXAMPLE 1

Test for Drying Steel Balls 100 grams of stainless steel balls of 2 to 3 mm. diameter are washed in trichloro-1,1,2-trifluoro-1,2,2-ethane then in anhydrous methanol and dried in an oven at 100°C, cooled and weighed. At immersion in water, the balls are drained in bulk in such a manner that only the water retained by surface tension and/or adhesion is retained. The balls are then weighed in order to determine the quantity of water retained then immersed for 1.5 minutes in a composition consisting of 99.6% by weight of trichloro-1,1,2-trifluoro-1,2,2-ethane and 0.4% by weight of dioleyl oleylamidopropylenediamide. Agitation of the liquid composition is effected ultrasonically. It is found that, in ten trials, an average of 99.95% of the retained water is removed from the balls.

A control experiment shows that no water is removed from the balls by treatment with trichloro-1,1,2-trifluoro-1,2,2-ethane containing no diamide.

EXAMPLE 2

Drying of Printed Electronic Circuits

The circuits printed on a support of urea formaldehyde resin are degreased by treatment with trichloro-1,1,2-trifluoro-1,2,2-ethane, immersed in tap water then immediately plunged for 3 minutes in the composition used in Example 1. The bath of liquid being at boiling point. It is found, in ten trials, that 100% drying is obtained for the printed circuits.

EXAMPLE 3

Drying of Electro-Mechanical Relays

Five miniature electro-magnetic relays are first degreased by treatment with trichloro-1,1,2-trifluoro-1,2,2-ethane, then immersed in tap water and plunged for three minutes in the liquid composition of Example 1, the liquid bath being agitated ultrasonically. The relays are then rinsed with anhydrous methanol and the water content of the used methanol is measured by the Karl Fischer method. It is found that, in a series of five trials, a degree of drying of 100% is obtained for these relays.

EXAMPLE 4

There is introduced in a 500 ml. liter flask (flask *a*) 300 mls. of a drying composition consisting of 99.6% by weight of trichloro-1,1,2-trifluoro-1,2,2-ethane and 0.4% by weight of dioleyl oleylamidopropyleneamide then 100 mls. of tap water. The water forms a layer above the drying composition. The flask is then strongly agitated for one minute in order to obtain an emulsion of drying composition and water. After this agitation the flask is allowed to rest. In one minute a layer forms above the drying composition which is slightly turbid. At this moment, the time required for separation of emulsion into two components is noted.

By way of comparison there is introduced to another flask (flask *b*), identical to the first and securely sealed, 300 mls. of a drying composition consisting of 99.6% by weight of trichloro-1,1,2-trifluoro-1,2,2-ethane and 0.4% by weight of oleylaminopropyleneamine dioleate and 100 mls. of tap water. The water forms a layer above the drying composition. The flask is then strongly agitated for one minute to form an emulsion of the drying composition and the water. After agitation, the flask is allowed to rest. In one minute a layer forms above the drying composition which is slightly turbid. The time required for the emulsion to separate into its components is measured. The results obtained are shown in Table 1.

Table 1

| | Flask B | Flask A |
|---|---|---|
| | Time lapse after end of agitation | |
| Formation of emulsion layer at surface | 1 mn | 1 mn |
| First drops of water obtained at emulsion surface | 3 h | 1 mn 30 s |
| Layer of water obtained at emulsion surface indicating the separation of half this emulsion | 25 h | 5 mn |
| Total separation of emulsion giving 100 ml of perfectly clear water at the surface of 300 ml of perfectly liquid drying composition | 48 h | 15 mn |

Table 1 shows that there is obtained total separation of water from the drying composition of the invention after 15 minutes whereas it is necessary to wait more than 48 hours with the drying composition containing diamine salt.

EXAMPLE 5

In order to show that the drying composition of this invention is capable of avoiding loss in use, the following test is carried out.

Into 95 liters of the drying composition, consisting of 99.6% by weight of trichloro-1,1,2-trifluoro-1,2,2-ethane and 0.4% by weight of dioleyl oleylamidopropyleneamide, there is added continuously progressively increasing quantities of tap water until there is obtained a loss of drying composition by formation of an emulsion thereof with the water. The results obtained are shown in Table 2.

Table 2

| Amount of water introduced continuously | Loss of drying composition |
|---|---|
| ml/mm | g/h |
| 200 | 0 |
| 300 | 0 |
| 500 | 0 |
| 750 | 0 |
| 1000 | 200 |

By way of comparison Example 5 is repeated but replacing the dioleyl oleylamidopropyleneamide with the same quantity of oleylaminopropyleneamine dioleate which is the salt of the amine corresponding to the diamide of the invention. The results obtained are shown in Table 3.

Table 3

| Amount of water introduced continuously | Loss of drying composition |
|---|---|
| ml/mn | g/h |
| 150 | 0 |
| 200 | 560 |
| 300 | 1500 |

It will be seen that, with the drying composition of the invention, the losses are zero until the quantity of water added reaches 750 ml per minute, whereas with the drying composition containing the diamine salt losses are already apparent when the quantity of water added reaches 200 ml per minute.

EXAMPLE 6

Drying of Printed Electronic Circuits

Printed circuits on a urea-formaldehyde resin support are, after immersion in water, plunged for two minutes in a bath in vessel 1, containing a composition consisting of 99.5% by weight of trichloro-1,1,2-trifluoro-1,2,2-ethane and 0.5% by weight of dioleyl oleylamidopropyleneamide, plunged for two minutes in a rinsing bath 2 containing trichloro-1,1,2-trifluoro-1,2,2-ethane, and passed for ten seconds in the vapor phase 4 and then removed from the apparatus.

The rate of recycling in the vessel 1 is varied and the percentage of water eliminated in relation to the quantity of water retained by the printed circuits is noted. Table 4 gives the results obtained as a function of the circulation time of the bath 1, that is to say the time required for recycling of the volume of composition equal to the volume of the bath.

Table 4

| Circulation time of bath(1) | % of water removed on amount of water retained |
|---|---|
| mn | |
| 5 | 97 |
| 10 | 100 |
| 15 | 99.8 |

These results show that the percentage of water eliminated depends upon the circulation time. Too rapid rate of circulation causes a disturbance of the boiling of the bath 1 and a speed of circulation which is too low reduces the efficiency of removal of water.

EXAMPLE 7

Drying of Electric Contactors

Using the same composition as in Example 6 and using a circulation time of bath 1 of 15 minutes, a series of 100 electric contactors or plastics material are treated under the same conditions as in Example 1. It is found that the amount of water removed is 100%. There is introduced in the bath 1 continuously 400 liters of water at a rate of 12 liters per hour which, taking into account the amount of water retained by contactor, corresponds to the introduction and the elimination of water in the apparatus by 400,000 contactors identical to the above. The circulation time of bath 1 is maintained at 15 minutes and there is treated under the same conditions a second series of 100 contactors identical to those above. It is found that the removal of water reaches 100%.

These results show that the percentage of water removed is practically independent of the number of articles.

EXAMPLE 8

Drying of Tissues

Using the same composition as in Example 6 and using a circulation time of bath 1 of 15 minutes, there is treated a piece of velvet tissue composed of polyamide fibre of dimensions 100 cms. × 2.5 cms. It is found that the amount of water removed is 98%. This result illustrates the efficiency of the removal of water from very absorbent materials, such as fibres made from natural or synthetic materials.

It will be understood that changes can be made in formulation, apparatus and operating conditions, without departing from the spirit of the invention, especially as defined in the following claims.

We claim:

1. A homogeneous liquid composition, comprising (a) 90 to 99.95% by weight of a solvent of which at least 50% by weight is trichloro-1,1,2-trifluoro-1,2,2-ethane, and (b) 0.05 to 10% by weight of one or more diamides having the formula (I):

$$R^1-CO-\underset{\underset{R}{|}}{N}(CH_2)_n-NH-CO-R^1$$

in which

R is a saturated or unsaturated aliphatic hydrocarbon group having from 1 to 25 carbon atoms, $R^1$ is an aliphatic hydrocarbon group having from 10 to 30 carbon atoms and at least one ethylenic double bond, and $n$ is a whole number from 1 to 9.

2. A composition as claimed in claim 1, in which R has from 11 to 20 carbon atoms and $R^1$ has from 11 to 18 carbon atoms and 1 to 2 ethylenic double bonds.

3. A composition as claimed in claim 1, in which the diamide is selected from the group consisting of dioleyloleylamidopropylene amide, diundecylenyloleylamidopropylene amide, dioleylstearyl-amidopropylene amide, dioleyl-palmitylamidopropylene amide, dilinoleyloleylamidopropylene amide and a mixture thereof.

4. A composition as claimed in claim 1, in which the solvent contains in addition to trichloro-1,1,2-trifluoro-1,2,2-ethane, one or more of the members of the group consisting of chloroform, methylene chloride, dichloroethane, trichloroethane, tetrachloro-1,1,2,2-ethane, tetrachloro-1,1,2,2-difluoro-1,2-ethane and trichlorofluoromethane.

5. The composition as claimed in claim 1, in which the diamine salt comprises the product of the condensation of 2 mols of an acid having the formula $R^1$—COOH with 1 mol of amine having the formula R—NH—$(CH_2)_n$—$NH_2$.

6. The composition as claimed in claim 5, in which the diamine salt is present in an amount up to 10% by weight of the diamide.

7. The composition as claimed in claim 5, in which the diamine salt is present in an amount up to 5% by weight of the diamide.

8. The composition as claimed in claim 5 in which the diamine salt is present in an amount up to 2% by weight of the diamide.

9. A method of removing water and undesirable particles from a surface, comprising treating the surface with a composition comprising (a) 90 to 99.95% by weight of a solvent of which at least 50% by weight is trichloro-1,1,2-trifluoro-1,2,2-ethane, and (b) 0.05 to 10% by weight of one or more diamides having the formula (I):

$$R^1\text{—CO—}\underset{\underset{R}{|}}{N}(CH_2)_n\text{—NH—CO—}R^1$$

in which R is a saturated or unsaturated aliphatic hydrocarbon group having from 1 to 25 carbon atoms, $R^1$ is an aliphatic hydrocarbon group having from 10 to 30 carbon atoms and at least one ethylenic double bond, and $n$ is a whole number from 1 to 9.

* * * * *